United States Patent [19]

Stevens

[11] 4,041,631

[45] Aug. 16, 1977

[54] VISUAL DISPLAY BOARD OR PANEL

[76] Inventor: Arthur William Stevens, Courtdale House, Streete Court, Westgate-on-Sea, Kent, England

[21] Appl. No.: 550,862

[22] Filed: Feb. 18, 1975

[30] Foreign Application Priority Data

Feb. 21, 1974 United Kingdom ..... 7976/74

[51] Int. Cl.[2] ..... G09F 1/10

[52] U.S. Cl. ..... 40/124.2

[58] Field of Search ..... 40/63, 124, 124.2, 124.4, 40/23, 16, 159

[56] References Cited

U.S. PATENT DOCUMENTS

| | | | |
|---|---|---|---|
| 1,408,469 | 3/1922 | Rand | 40/124.2 |
| 2,592,386 | 4/1952 | Breakey | 40/63 R |
| 2,963,808 | 12/1960 | Guichard | 40/124.2 |
| 3,795,071 | 3/1974 | Wagner | 40/124.2 |

*Primary Examiner*—Louis G. Mancene
*Assistant Examiner*—Wenceslao J. Contreras

[57] ABSTRACT

A visual display panel has a backing sheet and strips integral with the sheet and defining with the sheet channels for receiving pieces of paper or card to be displayed. The panel is initially moulded with the strips extending from the panel at a comparatively obtuse angle, and then the strips are deformed to bring their free edges adjacent the backing sheet. Desirably the strips are each fastened to the backing sheet at an intermediate point between the root and the free edge of the strip.

8 Claims, 11 Drawing Figures

Fig. 2.
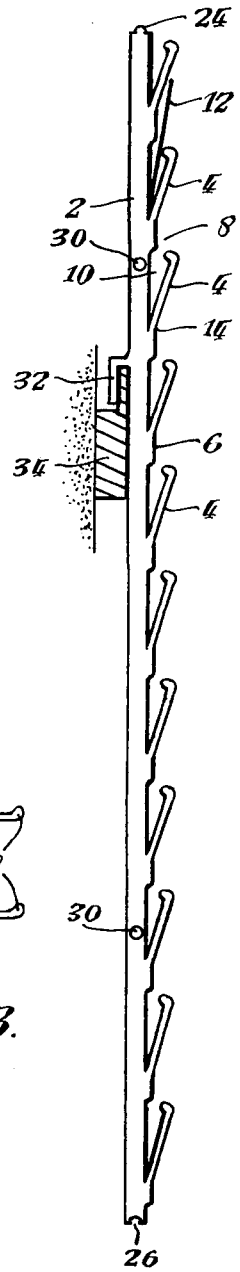
Fig. 1.
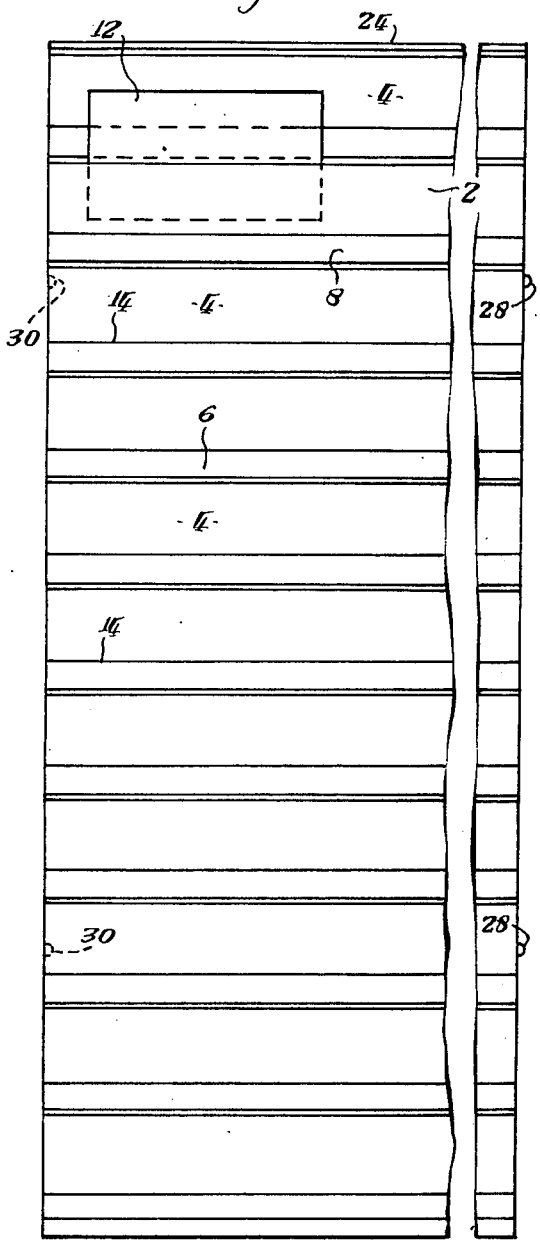
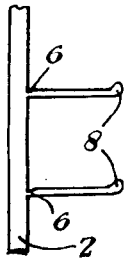
Fig. 3.

VISUAL DISPLAY BOARD OR PANEL

BACKGROUND OF THE INVENTION

1. Field of the Invention

This invention relates to panels used in visual display planning systems which may be in the form of wall charts.

2. Description of the Prior Art

It is known to form a panel from a backing sheet of plastics material and separate horizontal strips attached thereto, for example by welding, so as to define channels with the backing sheet, into which pieces of paper or card for instance can be inserted for display. The panel is thus made up of a large number of parts each individually fabricated and requiring considerable effort in assembly.

It has been proposed in Swedish specification No. 343246 to construct a double sided panel with strips at each side. The panel is there proposed to be extruded, and injection moulding would be quite impracticable if not impossible for the panel illustrated. The problems of moulding such a complex article have clearly not been realized, let alone solved.

SUMMARY OF THE INVENTION

The object of the invention is to provide a panel having a backing sheet and a plurality of strips defining with the sheet a plurality of channels, which can easily and economically be moulded in one-piece.

Another object is to provide a method of making such a panel.

According to this invention there is provided a visual display panel comprising a backing sheet and a plurality of generally parallel strips formed in one-piece therewith, each strip having two longitudinal edges and being integrally joined to the backing sheet at a first one of said edges, the other being free and closely adjacent to said backing sheet whereby a channel is defined between the backing sheet and the strip, said strips having been initially moulded integrally with said backing sheet so as to jut outwardly therefrom and subsequently being deformed to bring their free edges adjacent said backing sheet.

In one construction, each strip is formed integrally with the backing sheet at its root and is further fastened to the backing sheet intermediately between the root of the strip (where it joins the backing sheet) and the free edge. This fastening may be by mechanical interlocking, which preferably takes place at the time when the strips are deformed to bring their free edges adjacent the backing sheet. This may be effected by providing a rib on the inside face of each strip between the root and the free edge and a corresponding undercut recess on the backing sheet. When the strips are deformed, the rib is urged into the undercut and forms a mechanical lock.

The fastening may alternatively be by a weld between each strip and the backing sheet at a position between the root and free edge of the strip.

A preferred material for the panels according to the invention is polypropylene.

In another aspect of this invention there is provided a method of manufacturing a visual display panel comprising forming a backing sheet with a plurality of integral strips extending therefrom at a comparatively obtuse angle and deforming the strips to bring their free edges into close proximity with the backing sheet.

In one form of this method, each strip is fastened to the backing sheet intermediately between the root of the strip and its free edge. The fastening may be by mechanical interlocking, preferably taking place during the deforming of the strips, or may be by welding.

A preferred method for carrying out such mechanical interlocking is to provide a rib or projection on the inside face of each strip between its root and its free edge, and an undercut recess on the backing sheet. When the strips are deformed, the ribs are pushed into the undercut recess, and form a mechanical lock. Deformation of the rib to the shape of the undercut recess may occur.

The panels are preferably formed by injection moulding, and the deformation is then carried out directly after the moulding step.

BRIEF DESCRIPTION OF THE DRAWINGS

In order that the invention may be understood more readily, an embodiment and modifications will be described with reference to the accompanying diagrammatic drawings, wherein:

FIG. 1 is a front view of one end of a planning panel;

FIG. 2 is an end view of the panel of FIG. 1, showing a possible manner of attachment to a wall;

FIG. 3 is an end view of part of the same panel before the deformation step;

DESCRIPTION OF THE PREFERRED EMBODIMENTS

Figure 4:
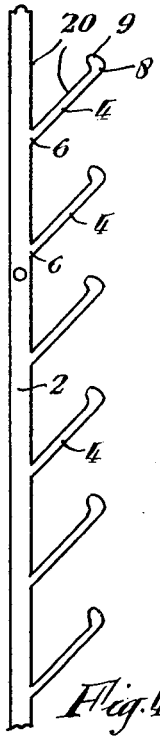
FIGS. 4, 5, 6 and 7 are end views of parts of moulded panels before the deformation step has been carried out, showing the various means of effecting fastening.
Figure 5:
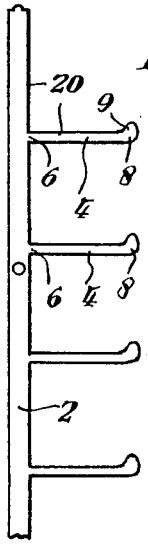
Figure 6:
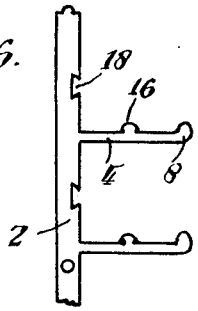

Referring first to FIGS. 1 and 2 of the drawings, a planning panel consists of a backing sheet 2, and a plurality of strips 4 formed integrally with it. Each strip joins a backing sheet 2 at a root 6, and extends upwardly to a free edge 8 with an inturned rib 9 lying close to sheet 2. There are thus formed a plurality of channels 10, each terminating at a narrow slit between the free edge 8 and the backing sheet 2. Into these channels there may be pushed pieces of paper or card to form a visual display for example for progress-planning purposes. One such piece is shown at 12.

The panel is initially injection moulded all in one piece with the strips 4 projecting outwardly from the panel as seen in FIG. 3. Next, the panel is rolled or pressed so that these strips are deformed towards the backing sheet to bring the inturned rib 9 along the free edge 8 of each strip adjacent the backing sheet 2, and/or the lower part of the next strip.

In these embodiments, each strip as well as being integrally united with the sheet 2 at its root 6 and deformed to overlie the sheet, is fastened to the backing sheet 2 along a line 14, between the root 6 and the free edge 8 of the strip. This fastening may be by a mechanical lock, or by known plastics welding techniques, e.g., high frequency, ultra sonic or solvent welding. Fastening is desirably carried out simultaneously with the deformation step.

Each panel has a longitudinal raised rib 24 at its top and a corresponding longitudinal groove 26 at its bottom. It also has a pair of short projecting studs 28 at its right hand side, and corresponding recesses 30 at its left.

When a plurality of panels are assembled together to form a display the rib 24 and studs 28 on one panel will engage the groove 26 of one adjoining panel and the recesses 30 of another, assisting in correctly locating each panel in the display. The studs 28 are short enough, to allow a single panel to be removed from a display without substantial disturbance of the surrounding panels.

A cursor can be slidingly received on the rib 24 and groove 30 of a panel, if desired.

The manner of intermediate fastening is not shown in FIGS. 1 to 3. Various methods of fastening will not be described with reference to FIGS. 4 to 11.

Figure 7:
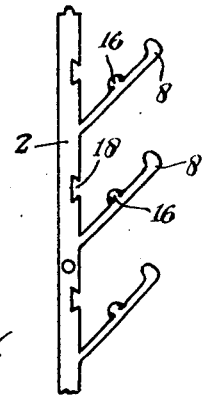
Figure 9:
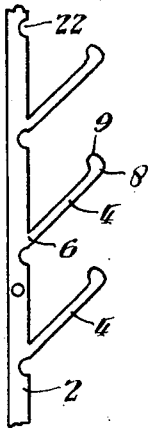
FIGS. 8 and 9 are similar views but also showing a further modification.

The strips 4 may initially be moulded to lie at right angles to the backing sheet 2, as shown in FIGS. 5, 6, 8, 10 and 11, but they could make an angle with the backing sheet. It is preferred that they are inclined somewhat toward their eventual deformed position, as shown in FIGS. 4, 7 and 9. The angle of inclination to the sheet should be greater than 35° preferably at least 45°.

If the strips 4 are to be fastened to the backing sheet 2 by a mechanical fastening, as shown in FIGS. 5, 6, 7 and 11 they are each formed with a rib 16, corresponding in position to an undercut recessed channel 18 in the backing sheet 2. When the strips are deformed, the ribs 16 make a fit into the recesses 18 in the backing sheet and are held locked there when the panel has cooled. This holds the free edges 8 of the strips 4 to the backing sheet so that paper, etc., may be firmly and strongly clipped in position between the edge and sheet.

It is also possible to achieve intermediate fastening by welding the strips 4 to the backing sheet at the position 14 (FIG. 2). No rib 16 need then be provided, as shown in FIGS. 4, 5, 9 and 10, in which figures the points on the strips and the sheet are joined by welding are indicated by the reference numeral 20.

Figure 8:
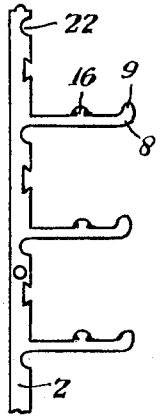
Figure 10:
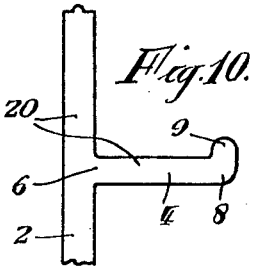
FIGS. 10 and 11 are enlargements of parts of FIGS. 5 and 8 showing the end of a single strip in each case.
Figure 11:
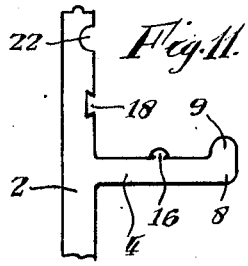

FIGS. 8, 9 and 11 show a modification which may be incorporated. The backing sheet is formed with curved recesses 22 which are lightly engaged by the inwardly turned ribs 9 on the free ends 8, so assisting in retaining pieces of paper or card in the channels 10.

While the backing sheet is herein illustrated as a continuous web, it might alternatively be foraminate in order to lighten the panel.

The panels may with advantage be made of a size which can be photocopied, for example of international A4 size. A plurality of such panels can be used to form a wall display. Magnets may be fastened, e.g., with adhesive, to the rear of the panels to allow them to be placed on and held, to a vertical metal sheet. The rear of the backing surface may be provided with an undercut hooked strip 32 (FIG. 2) to support the panel by engagement with a grooved track 34 on a wall.

While the invention has been illustrated above by reference to preferred but non-limitative embodiments thereof, it will be understood by those skilled in the art that various changes may be made without departing from the spirit and scope of the invention and it is intended to cover all such changes and modifications by the appended claims.

What is claimed is:

1. A visual display panel comprising a backing sheet and a plurality of generally parallel strips formed in one-piece therewith, each strip having two longitudinal edges and being integrally joined to the backing sheet at a first one of said edges, the other edge being free and closely adjacent said backing sheet whereby a channel is defined between the backing sheet and the strip, said strips having been initially moulded integrally with said backing sheet so as to jut outwardly therefrom and subsequently being deformed to bring their free edges adjacent said backing sheet and wherein each strip has a further fastening to the backing sheet.

2. A panel according to claim 1 made of polypropylene.

3. A visual display panel comprising a backing sheet and a plurality of generally parallel strips formed in one-piece therewith, each strip having two longitudinal edges and being integrally joined to the backing sheet at a first one of said edges, the other edges being free and closely adjacent to said backing sheet whereby a channel is defined between the backing sheet and the strip, each strip having a further fastening to the backing sheet intermediate between said edges.

4. A panel according to claim 3 wherein each strip has a rib or projection intermediate between said edges, the backing sheet having an undercut recess corresponding to each said rib or projection, and said further fastening is a mechanical interlock between a said rib and a said undercut recess.

5. A panel according to claim 3 wherein said further fastening is a line of welding.

6. A panel according to claim 3 wherein the backing sheet is rectangular, having two pairs of opposed edges, one edge of one pair having a longitudinal rib formed thereon and the other edge of that pair having a corresponding longitudinal groove so that a cursor can be slidingly engaged on said rib and said groove, one edge of the other pair having projecting studs formed thereon, the opposed edge having corresponding recesses.

7. A panel according to claim 3 having strips on only one surface of said backing sheet.

8. A panel according to claim 3 wherein each strip has an inturned rib at its free edge and the backing sheet has a corresponding longitudinal recess lightly engaged by each said rib.

* * * * *

UNITED STATES PATENT OFFICE

CERTIFICATE OF CORRECTION

Patent No. 4,041,631 Dated August 16, 1977

Inventor(s) Arthur William Stevens

It is certified that error appears in the above-identified patent and that said Letters Patent are hereby corrected as shown below:

On the cover sheet Item (73) Assignee should read:

-- Monodex Business Systems Limited, Kent, England --.

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*